US008256756B2

(12) United States Patent
Myoki

(10) Patent No.: US 8,256,756 B2
(45) Date of Patent: Sep. 4, 2012

(54) PRINTING SYSTEM, CONTROL METHOD FOR PRINTING SYSTEM, AND STORAGE MEDIUM

(75) Inventor: Yutaka Myoki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 508 days.

(21) Appl. No.: 12/489,196

(22) Filed: Jun. 22, 2009

(65) Prior Publication Data

US 2009/0315240 A1 Dec. 24, 2009

(30) Foreign Application Priority Data

Jun. 23, 2008 (JP) ..... 2008-163667

(51) Int. Cl.
*B41F 13/56* (2006.01)

(52) U.S. Cl. ..... 270/21.1; 83/934; 270/58.07

(58) Field of Classification Search ..... 270/21.1, 270/39.06, 58.07, 58.09, 58.11; 493/352, 493/356; 83/76.9, 934
See application file for complete search history.

(56) References Cited

U.S. PATENT DOCUMENTS 6,532,856 B2 * 3/2003 Kato et al. ..... 83/934
2008/0237962 A1 * 10/2008 Kubota et al. ..... 270/21.1

FOREIGN PATENT DOCUMENTS

JP 10-186959 7/1998
JP 2001-163514 6/2001
JP 2006-193288 7/2006

* cited by examiner

*Primary Examiner* — Ren Yan
(74) *Attorney, Agent, or Firm* — Canon USA Inc. IP Division

(57) ABSTRACT

A printing system includes a processing unit configured to cause a sheet processing unit to execute a sheet processing including a folding processing and a trimming processing on a printed sheet by executing a job, a determining unit configured to determine whether a fold line of a sheet folded by the folding processing is cut out by the trimming processing, and a control unit configured to perform controlling such that the fold line of the sheet folded by the folding processing is not cut out by the trimming processing if the determining unit determines that the fold line of the sheet folded by the folding processing is cutout by the trimming processing.

7 Claims, 18 Drawing Sheets

FIG. 9

```
001 <PRINT CONTROL INFORMATION>
002  <PRINT JOB   NUMBER OF SHEETS: 4>
003    <SHEET NUMBER: "1 - 4">
004     <PAPER SIZE: "A3 Nobi"/>
005     <FOLDING: "NONE"/>
006    </SHEET>
007    <BINDING: "SADDLE STITCH"/>
008    <TRIM SIZE:"A4"/>
009  </PRINT JOB>
010 </PRINT CONTROL INFORMATION>
```

FIG. 11

```
001 <PRINT CONTROL INFORMATION>
002  <PRINT JOB   NUMBER OF SHEETS: 4>
003    <SHEET NUMBER: "1 - 2">
004     <PAPER SIZE: "A4 Nobi"/>
005     <FOLDING: "NONE"/>
006    </SHEET>
007    <SHEET NUMBER: "3">
008    <PAPER SIZE:"A3 Nobi"/>
009    <FOLDING: "Z FOLD"/>
010    </SHEET>
011    <SHEET NUMBER:"4">
012     <PAPER SIZE: "A4 Nobi"/>
013     <FOLDING: "NONE"/>
014    </SHEET>
015    <BINDING: "NONE"/>
016    <TRIM SIZE: "A4"/>
017  </PRINT JOB>
018 </PRINT CONTROL INFORMATION>
```

PRINTING SYSTEM, CONTROL METHOD FOR PRINTING SYSTEM, AND STORAGE MEDIUM

BACKGROUND OF THE INVENTION

1. Field of the Invention

The present invention relates to a printing system, a control method for the printing system, and a storage medium.

2. Description of the Related Art

Currently, in printing systems for the print on demand (POD) market, a printing machine and various post processing machines are directly connected (in-line connected) for performing folding and trimming (cutting) processing on printed sheets.

In such a printing system, when the printed sheets are folded or trimmed (cut), if a discharging unit for discharging the folded sheets and the cutting unit for receiving the folded sheets are not connected, or depending on a combination of the folding method and the trimming (cutting) method, a fold-line portion of the folded sheets may be cut off.

For this reason, an operator of the printing system is unable to select the trimming (cutting) process when the folding processing is performed on the sheets. Further, the operation via the operation panel is limited so that a specified trimming (cutting) method (e.g., fore edge trimming (cutting)) is not performed when a specified fold processing method (e.g., Z fold) is designated.

Depending on a combination of the folding method and the trimming (cutting) method, the fold line portion of the folded sheets may be cut off. A technique below is known for solving such a problem.

For example, Japanese Patent Application Laid-Open No. 2001-163514 discusses a method in which two fold lines of a Z-folded sheet are set inside each edge of the folded sheet so that the folded sheet can be trimmed (cut) without the fold lines being cut off. Further, whether a portion that is to be finally trimmed (cut) is included in a sheet is determined, and the folding position is changed based on a result of the determination.

Further, Japanese Patent Application Laid-Open No. 10-186959 discusses a method in which if sheets that need folding and sheets that do not need folding are mixed, the sheets are classified into two groups that need folding and that do not need folding. Then, the sheets that need folding are printed together. Similarly, the sheets that do not need folding are printed together. In this way, the sheets that do not need folding can be selected and trimmed (cut).

However, there may be a problem in using the above-described method to the above-described conventional printing system. The printing machines for the print on demand (POD) market are capable of printing sheets of various size and paper quality or sheets that are processed by different processing methods in one print job.

In a method where operation via the operation panel is limited so that a specified trimming (cutting) method (e.g., fore edge trimming (cutting)) cannot be applied to sheets that have undergone a specified folding method (e.g., Z fold), the method is not applicable when the folded sheets are mixed with the non-folded sheets.

Further, depending on the details of the printing, only a specified folding position is allowed or the folding position is designated in the print order. In these cases, it is not always practical to automatically adjust the folding position and continue the printing at the POD site or the printing site as is discussed in Japanese Patent Application Laid-Open No. 2001-163514.

Further, depending on the details of the printing, there are cases where the output order is important or the output order is included in the order given by a client. In these cases, it is not always practical to classify the output that needs folding and the output that does not need folding at the POD site or the printing site as is discussed in Japanese Patent Application Laid-Open No. 10-186959.

SUMMARY OF THE INVENTION

The present invention is directed to a printing system and a control method of the printing system.

According to an aspect of the present invention, a printing system includes a processing unit configured to cause a sheet processing unit to execute a sheet processing including a folding processing and a trimming (cutting) processing on a printed sheet by executing a job, a determining unit configured to determine whether a fold line of a sheet folded by the folding processing is cut out by the trimming (cutting) processing, and a control unit configured to perform control such that the fold line of the sheet folded by the folding processing is not cut out by the trimming (cutting) processing if the determining unit determines that the fold line of the sheet folded by the folding processing is cut out by the trimming (cutting) processing.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features and aspects of the invention and, together with the description, serve to describe principles of the invention.

FIG. 9 illustrates an example of print control information used for the print job illustrated in FIGS. 6A to 6D.

FIG. 11 illustrates an example of print control information used for the print job illustrated in FIGS. 10A to 10D.

DETAILED DESCRIPTION OF THE EMBODIMENTS

Various exemplary embodiments, features, and aspects of the present invention will now be herein described in detail below with reference to the drawings.

Figure 1:
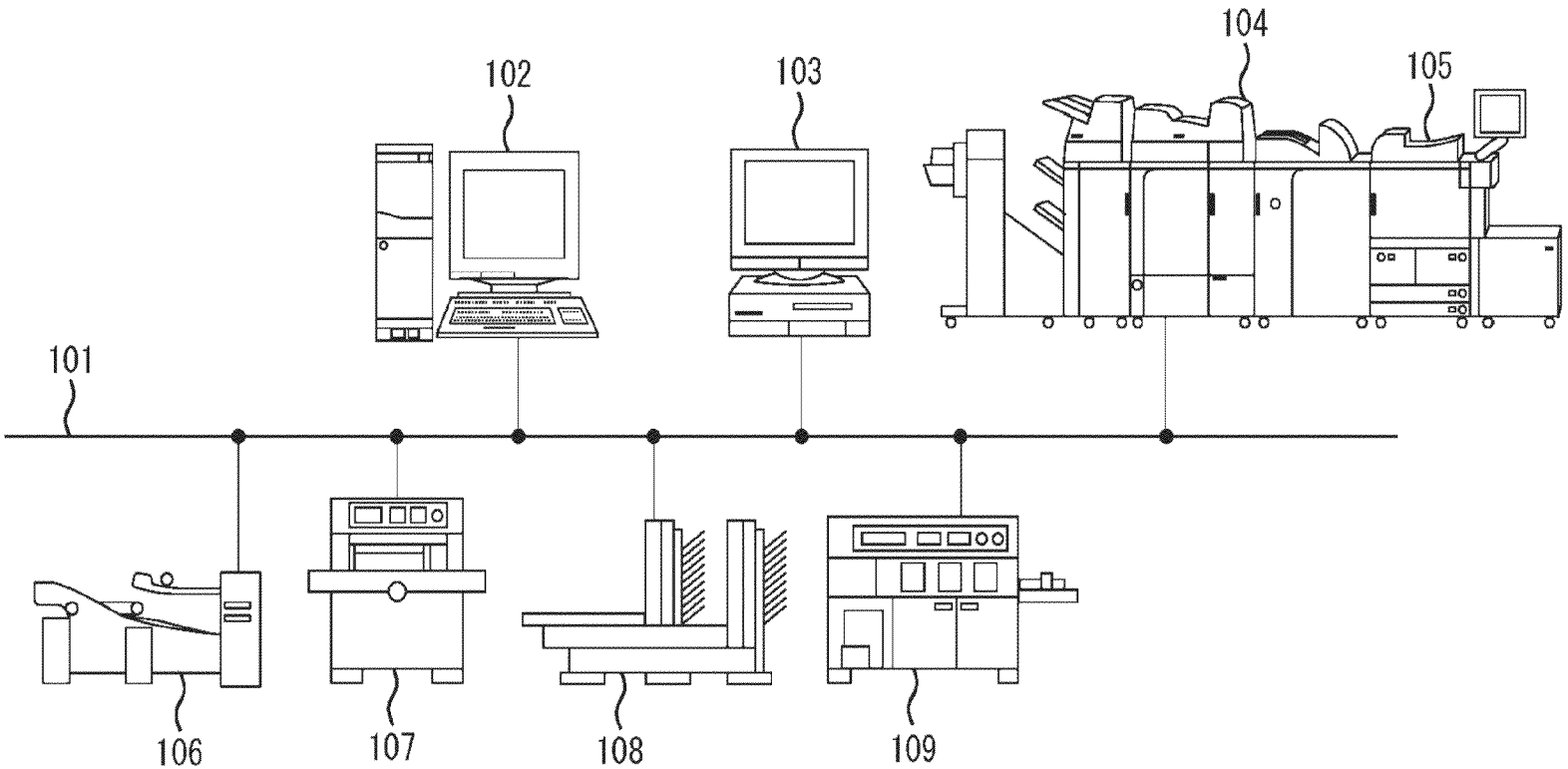
FIG. 1 illustrates a configuration of a POD system including a printing system according to a first exemplary embodiment of the present invention.

FIG. 1 illustrates a configuration of a POD system including a printing system according to a first exemplary embodiment of the present invention. The POD system includes a printing system 104, a server computer (PC) 102, and a client computer (PC) 103, all of which are connected via a network 101.

Further, the POD system includes a paper folding machine 106, a trimming machine 107, a saddle stitch binding machine 108, and a case binding machine 109, all of which are connected via the network 101. As described below, the printing system 104 includes a printing apparatus 105 and a sheet processing apparatus 205.

The server PC 102 manages transmission and reception of data between various apparatuses connected to the network 101. The client PC 103 transmits image data to the printing apparatus 105 and the server PC 102 included in the printing system 104 via the network 101.

The paper folding machine 106 folds a sheet that has been printed by the printing apparatus 105. The trimming machine 107 trims the sheets printed by the printing apparatus 105 for each sheet bundle that is made up from a plurality of the printed sheets.

The saddle stitch binding machine 108 performs saddle stitch bookbinding of the sheets printed by the printing apparatus 105. The case binding machine 109 performs case binding of the sheets printed by the printing apparatus 105.

According to the present exemplary embodiment, the sheet processing apparatus 205 of the printing system 104 functions as a bookbinding apparatus as described below, however, the bookbinding apparatus of the present invention is not limited to this apparatus.

For example, the server PC 102 or the client PC 103 can function as the bookbinding apparatus when it is used together with the paper folding machine 106, the trimming machine 107, the saddle stitch binding machine 108, and the case binding machine 109 connected via the network 101. Further, a post processing apparatus unconnected to the printing apparatus 105 can function as the bookbinding apparatus.

If the paper folding machine 106, the trimming machine 107, the saddle stitch binding machine 108, and the case binding machine 109 are used as the bookbinding apparatus, a user takes out the sheets printed by the printing apparatus 105 from the printing system 104 and set them in the apparatus by which binding is performed to execute the bookbinding process. At this time, data communication is possible between the apparatuses included in the POD system via the network 101.

Figure 2:
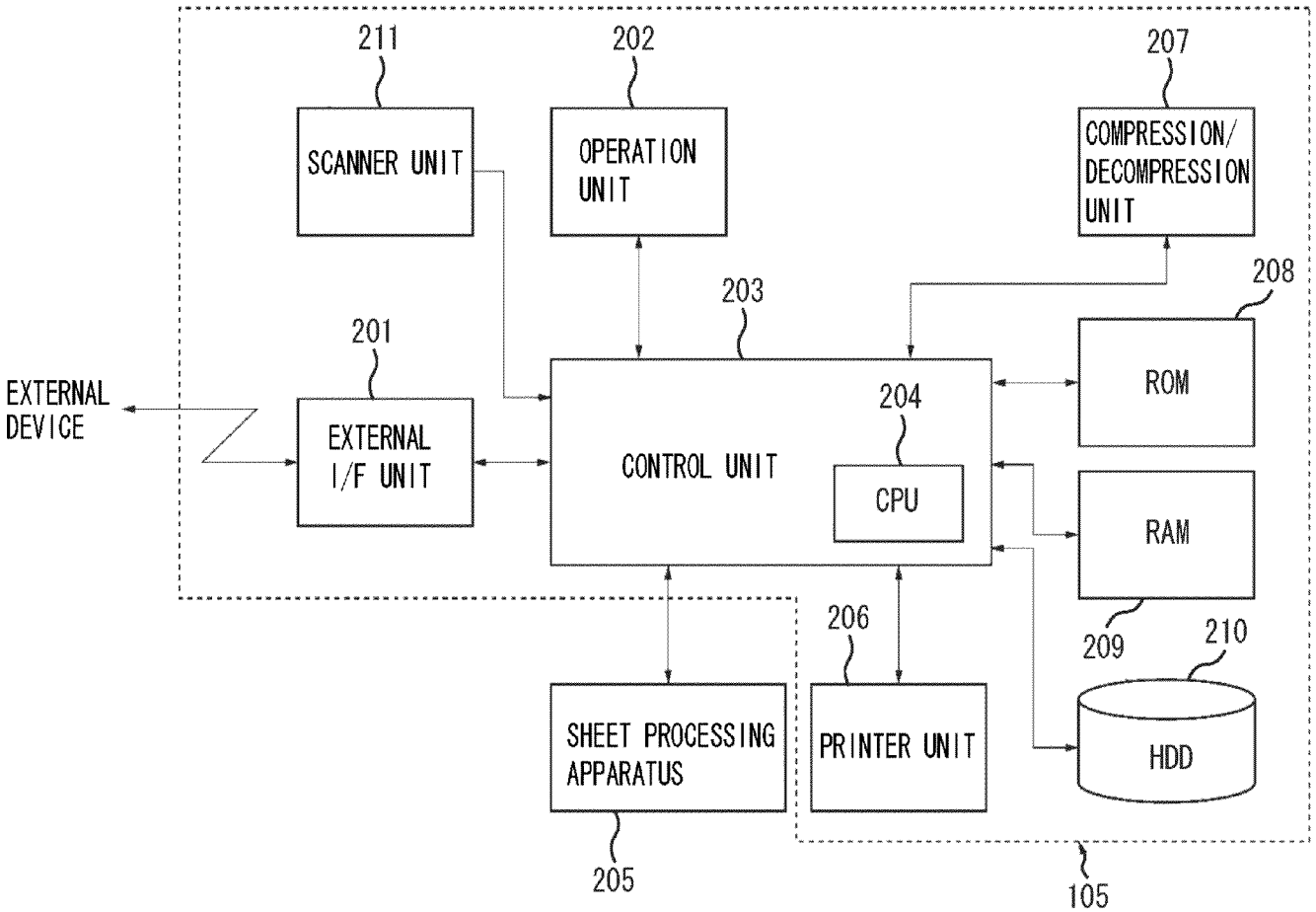
FIG. 2 is a block diagram illustrating a configuration of a control unit of the printing system.

FIG. 2 is a block diagram illustrating a configuration of a control unit of the printing system 104. As described above, the printing system 104 includes the printing apparatus 105 and the sheet processing apparatus 205. According to the present exemplary embodiment, a multifunction peripheral (MFP) having a plurality of functions including the copy function and the print function is used as an example of the printing apparatus 105. However, a monofunctional printing apparatus (printer) having only the copy function or the print function can also be used as an example of the printing apparatus 105.

In FIG. 2, each unit in the printing system 104 is included in the printing apparatus 105 except for the sheet processing apparatus 205. The sheet processing apparatuses 205 having an arbitrary number of units can be connected to the printing apparatus 105.

According to the printing system 104, the sheet processing for the sheets printed by the printing apparatus 105 can be executed by the sheet processing apparatus 205 connected to the printing apparatus 105. However, the printing system 104 can be configured only by the printing apparatus 105 without the sheet processing apparatus 205 being connected to the printing apparatus 105.

The sheet processing apparatus 205 can communicate with the printing apparatus 105. When the sheet processing apparatus 205 receives an instruction from the printing apparatus 105, a sheet processing described below is executed.

The printing apparatus 105 includes a control unit 203, an external interface (I/F) unit 201, an operation unit 202, a printer unit 206, a compression/decompression unit 207, a read only memory (ROM) 208, a random access memory (RAM) 209, a hard disk drive (HDD) 210, and a scanner unit 211.

The scanner unit 211 scans an image in a document, converts it into image data, and transfers the image data to another unit. The external I/F unit 201 transmits and receives data to and from another apparatus connected to the network 101.

The printer unit 206 prints an image based on the input image data on a sheet. The operation unit 202 includes a hard key input unit (key input unit) 702 and a touch panel unit 701, which are described below. The operation unit 202 receives an instruction from the user via these units. Further, the operation unit 202 displays various types of display on the touch panel unit 701.

The control unit 203 includes a central processing unit (CPU) 204 and performs overall control of the processing and operation of the various units in the printing system 104. In other words, the control unit 203 controls the operation of the printing apparatus 105 and the sheet processing apparatus 205 connected to the printing apparatus 105.

Various computer programs executed by the CPU 204 are stored in the ROM 208. For example, a program used for having the control unit 203 execute various processes illustrated in a flowchart described below, and a display control program necessary in displaying various setting screens described below are stored in the ROM 208.

Further, a program necessary for the control unit 203 in interpreting page description language (PDL) code data received from the server PC 102 or the client PC 103 and converting the PDL code data into raster image data is stored in the ROM 208. Further, boot sequence and font information is stored in the ROM 208.

Image data sent from the scanner unit 211 or the external I/F unit 201 and various programs or setting information loaded from the ROM 208 are stored in the RAM 209. Further, information on the sheet processing apparatus 205 is stored in the RAM 209.

The information on the sheet processing apparatus 205 includes a number of units in the sheet processing apparatus 205 connected to the printing apparatus 105, information on each function of the sheet processing apparatus 205, and connection order of each unit in the sheet processing apparatus 205. Writing data into the RAM 209 and reading data out of the RAM 209 is executed under control of the CPU 204.

The HDD 210 includes a hard disk and a drive unit that is used in reading data from the hard disk and storing data in the hard disk. The HDD 210 is a large-capacity storage device used for storing image data sent from the scanner unit 211 or the external I/F unit 201 and compressed by the compression/decompression unit 207. Further, as described below, a setting value (a recommended adjustment value or a user adjustment value) of each item is also stored in the HDD 210.

The control unit 203 outputs the image data stored in the HDD 210 to the printer unit 206 according to an instruction from the user so that the printer unit 206 performs the printing processing. Further, the control unit 203 sends the image data stored in the HDD 210 to an external apparatus such as the server PC 102 via the external I/F unit 201.

The compression/decompression unit 207 compresses/decompresses the image data stored in the RAM 209 or the HDD 210 according to various compression technologies based on, for example, Joint Bi-level Image experts Group (JBIG) and Joint Photographic Experts Group (JPEG).

Figure 3:
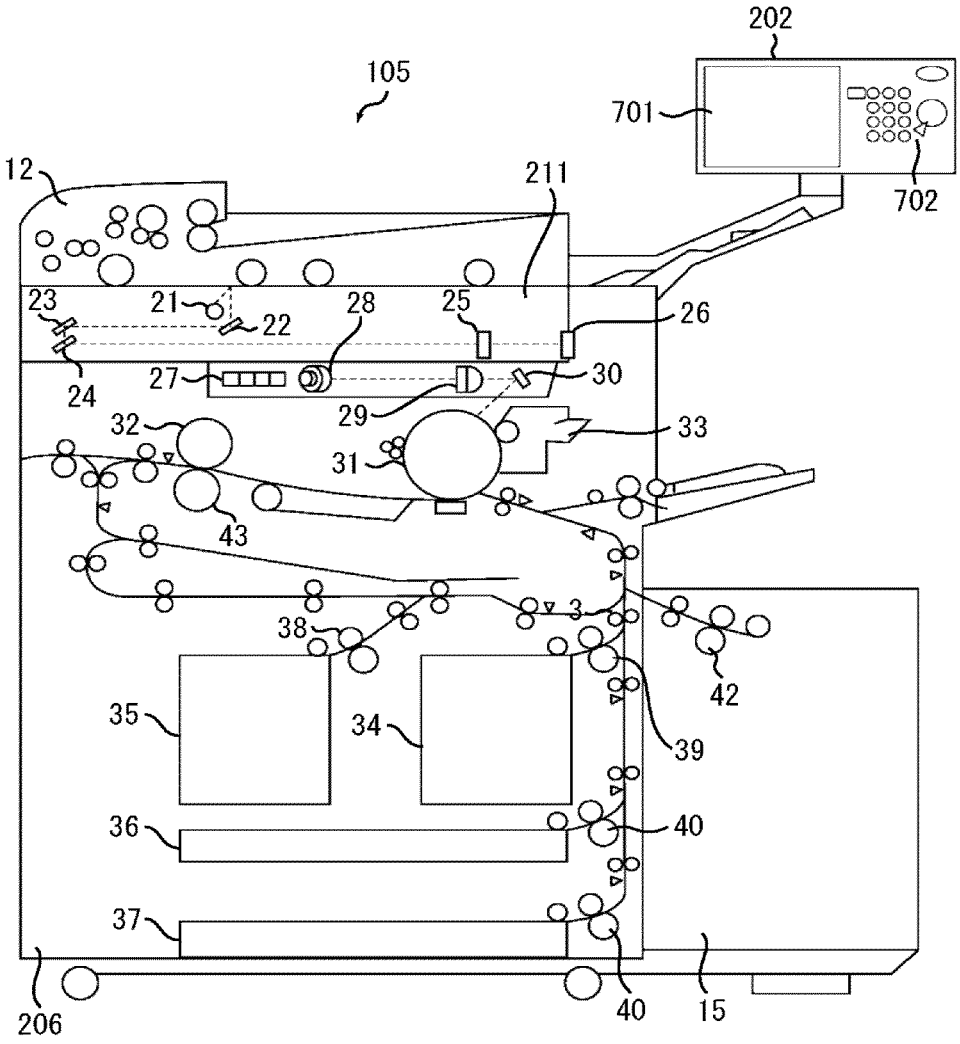
FIG. 3 is a section view of an inner configuration of a printing apparatus.

FIG. 3 is a section view of an inner configuration of the printing apparatus 105. Main components of the printing apparatus 105 are the printer unit 206 that outputs a document image on a sheet and the scanner unit 211 that scans data of the document image. An automatic document feeder 12 is provided above the scanner unit 211.

The user can operate the printing apparatus 105 by setting a mode of the apparatus, such as a copy mode, using the operation unit 202. Further, the user can make the touch panel unit 701 of the operation unit 202 display various setting values and the current job status of the printing apparatus.

Further, if any trouble occurs with the printing apparatus, a service person call is displayed on the touch panel unit 701. Further, when a jam occurs, the location of the jammed paper in the apparatus may also be displayed on the touch panel unit 701.

Additionally, the printer unit 206 includes paper feed stages 34 to 37. Sheets are stored in the paper feed stages. The user sets the sheets in the paper feed stages 34 to 37 depending on their size.

Further, a large-capacity paper deck 15 can be connected to outside of the printer unit 206. The sheet is conveyed to an image forming portion by paper feeding conveyance rollers 38 to 42 which are driven by a motor (not illustrated).

At the scanner unit 211, light is emitted from a light source 21 that moves from side to side in FIG. 3 and directed on a document placed on a document positioning plate at the upper portion of the scanner unit 211. The emitted light is reflected by the document and an optical image is formed at a charge-coupled device (CCD) 26 via mirrors 22 to 24 and via a lens 25.

At the CCD 26, the optical image formed thereon is converted into an electric signal. Accordingly, digital image data is generated. Then, the image data is subjected to image conversion such as enlargement/reduction according to a request of the user, and the converted image data is stored in an image memory (not illustrated).

When the image is output, the printer unit 206 reads the image data stored in the image memory and reconverts the digital signal into an analog signal. At the printer unit 206, a light signal of a laser beam corresponding to the analog signal is irradiated on the photosensitive drum 31, which is emitted from an optical emission unit 27 via a scanner 28, a lens 29, and a mirror 30 to scan the surface of the photosensitive drum 31.

A photo-conductive layer made of an organic photo-conductor is provided on the surface of the photosensitive drum 31. The photosensitive drum 31 rotates at a certain speed during the copy job. Toner (not shown) filled in a developer 33 is attracted on the photosensitive drum 31, and a visible image is formed on its surface.

On the other hand, the sheet fed from the paper feed stages 34 to 37 is conveyed through a paper conveyance path and passes under the photosensitive drum 31 at timing that corresponds to the visible image on the photosensitive drum 31. Then, by a transfer charging device 48, visible image on the photosensitive drum 31 is transferred onto the sheet. The sheet with the unfixed visible image (unfixed image) is fed to a gap between a fixing roller 32 and a pressure roller 43.

When the unfixed toner image is fixed by a fixing device that includes the fixing roller 32 and the pressure roller 43, the toner-fixed sheet is discharged to the sheet processing apparatus 205 provided outside of the printer unit 206.

Figure 4:
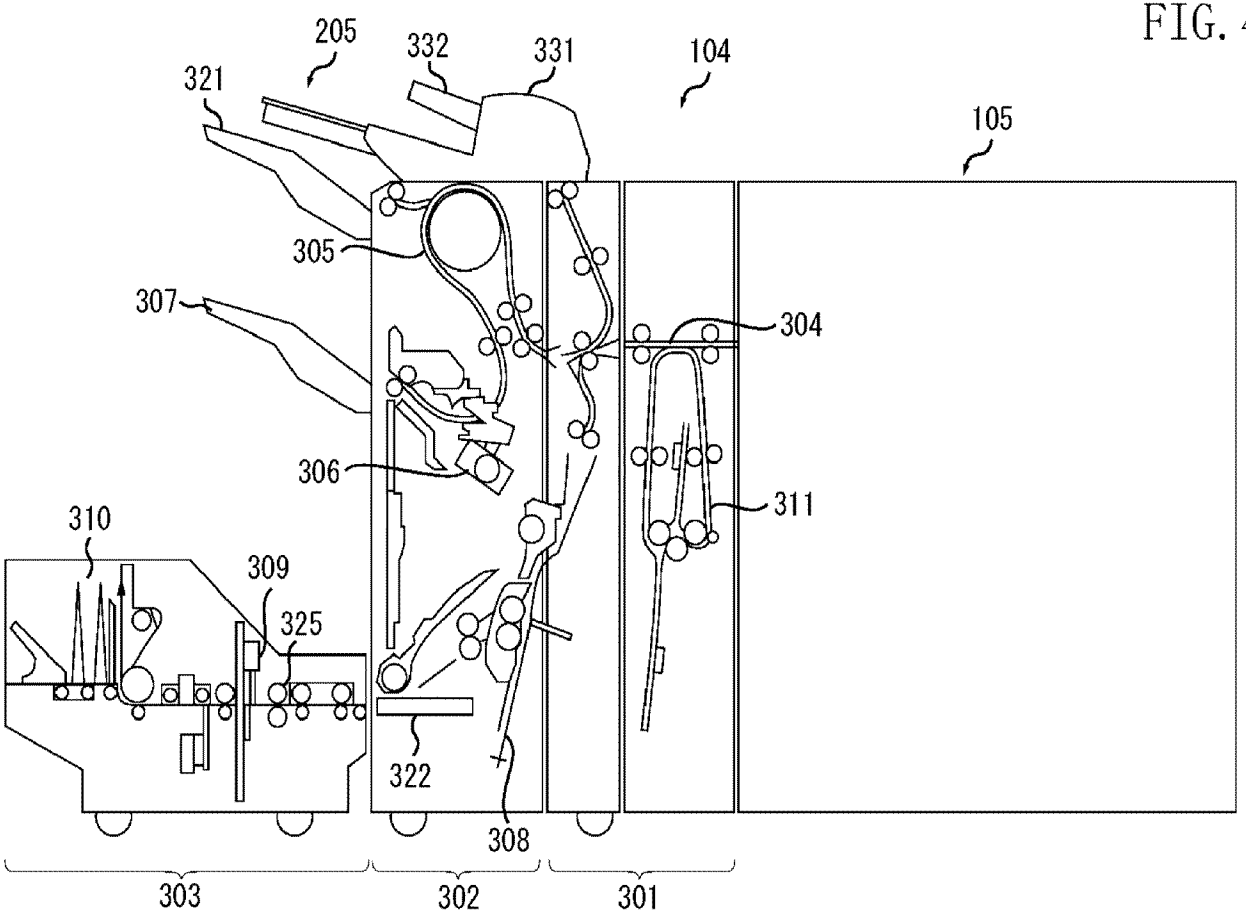
FIG. 4 is a section view of an inner configuration of a sheet processing apparatus.

FIG. 4 is a section view of an inner configuration of the sheet processing apparatus 205. An arbitrary number of an arbitrary type of apparatuses (units) can be connected to the sheet processing apparatus 205 so long as the sheet can be conveyed from an upper stream apparatus to a downstream apparatus via a sheet conveyance path.

In FIG. 4, the sheet processing apparatus 205 includes a paper folding machine 301, a saddle stitch binding machine 302, and a trimming machine 303 that are connected to the printing apparatus 105 in that order. The printing system 104 can selectively use each machine.

Further, each unit of the sheet processing apparatus 205 includes a discharging portion. The user can take out the sheet that has passed through the sheet processing from the discharging portion of each unit.

More specifically, the sheet that has passed through the fixing device of the printing apparatus 105 is discharged to the sheet processing apparatus 205. The sheet processing apparatus 205 includes a sample tray 321 and a stack tray 307. The tray onto which the sheet is discharged is changed depending on the job type or a number of sheets to be discharged.

The above-described paper folding machine 301 and the saddle stitch binding machine 302 are provided between the printing apparatus 105 and the two trays. The paper folding machine 301 includes a Z fold unit 311, and the sheet (paper) is Z-folded by the Z fold unit 311.

Since the Z folding is a known technique (see Japanese Patent Application Laid-Open No. 2006-193288), detailed description will be omitted. The Z-folded sheet is conveyed to the saddle stitch binding machine 302 via a conveying path 304.

The saddle stitch binding machine 302 includes a saddle stitcher 308. The saddle stitcher 308 binds the sheets at two places at the central portion and bites them by rollers so that the sheets are half folded. According to this process, a booklet in a form of a weekly magazine or a brochure is made. The sheets that are book bound by the saddle stitcher 308 are discharged on a booklet tray 322.

Additionally, although not illustrated, units for gluing (for bookbinding) and units for trimming the fore edge of the bound sheets which is performed after the binding is completed can be added.

Further, an inserter 331 is used for feeding a sheet set on a tray 332 to any of trays 307, 321, and 322 without the sheet passing through the printing apparatus 105. In this way, a sheet set on the inserter 331 can be inserted between the sheets that are fed to the sheet processing apparatus 205.

A sheet bundle in a form of a booklet (saddle-stitched booklet) that is output from the saddle stitcher 308 is fed to a trimming machine (trimmer) 303. Then, the sheet bundle, which is in a form of a booklet, is conveyed a predetermined length by a roller 325 and has its edge cut off by a cutter unit 309. In this way, the edges of a plurality of sheets that have been roughly aligned are neatly trimmed.

Next, the sheet bundle of the booklet having its edge trimmed is stored in a booklet hold unit 310. In addition to the cutter unit 309, the trimming machine 303 includes a cutter unit (not illustrated) in an upstream side of the conveying path of the sheet bundle and also another cutter unit (not illustrated) in a downstream side of the conveying path. According to these cutters, three side trimming as well as fore edge trimming are performed on the sheet bundle.

The control unit 203 instructs the printer unit 206 to execute printing of print data included in a printing execution request (print job). Further, the control unit 203 analyzes the print control information included in the printing execution request (print job) and determines the type of required sheet processing.

Next, under the control of the control unit 203, the printed sheet is conveyed to a unit of the sheet processing apparatus 205, which can execute the designated sheet processing, via a sheet conveyance path. Then the sheet processing is executed by the unit of the sheet processing apparatus 205.

Figure 5A:
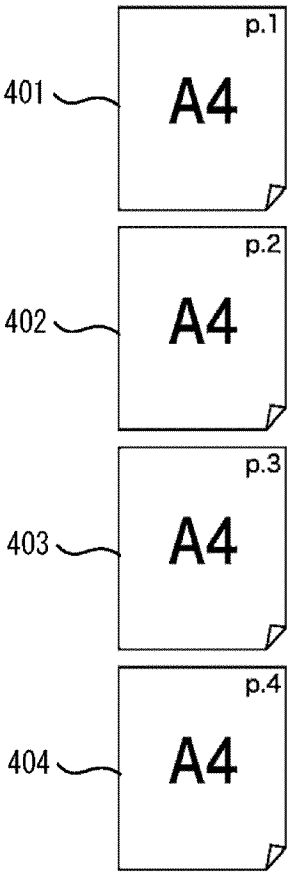
FIGS. 5A to 5C illustrate an example of a print job including a stapling process.
Figure 5B:
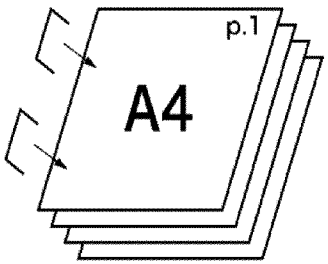
Figure 5C:
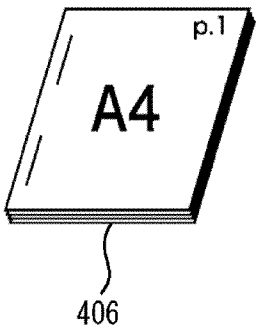
Figure 6A:
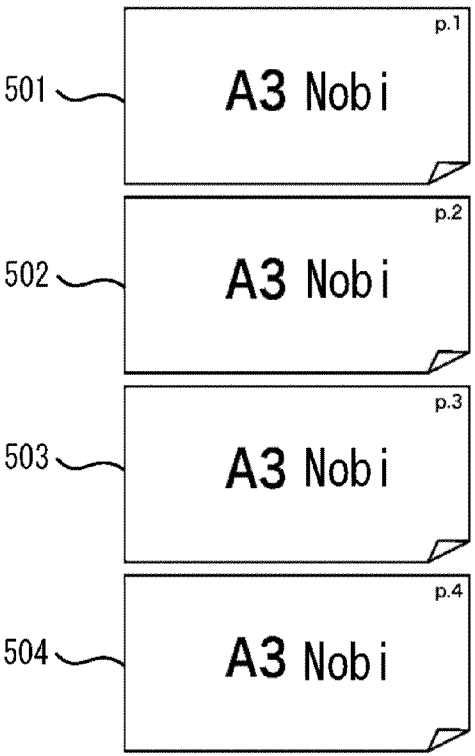
FIGS. 6A to 6D illustrate an example of a print job including the stapling process and a trimming (cutting) process.
Figure 6B:
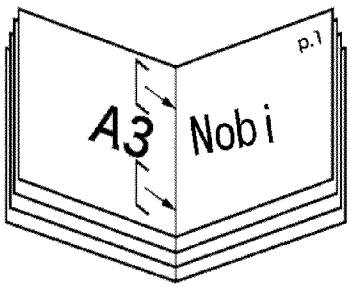
Figure 6C:
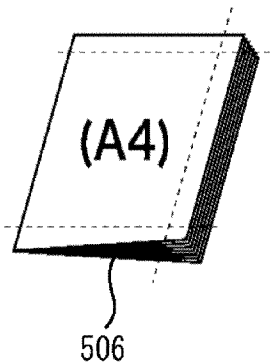
Figure 6D:
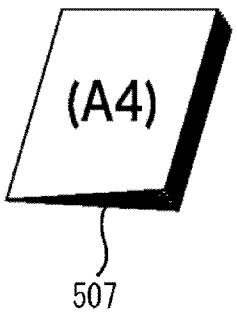

An example in which the print data is printed on four A4 size sheets and stapling is designated as the print control information is illustrated in FIGS. 5A to 5C.

FIGS. 5A to 5C illustrate an example of a print job including a stapling process. First, the control unit 203 instructs the printer unit 206 to print the print data. Printed sheets 401 to 404 are obtained according to this instruction (see FIG. 5A).

Next, under the control of the control unit 203, the printed sheets 401 to 404 are conveyed to a stapler 306 via the conveyance path 304 in the paper folding machine 301 and a conveyance path 305 in the saddle stitch binding machine 302.

Next, the control unit 203 instructs the stapler 306 to staple the printed sheets 401 to 404 that have been conveyed to the stapler 306 (see FIG. 5B). Then, the control unit 203 discharges the stapled sheet bundle 406 from the stack tray 307 (see FIG. 5C).

Additionally, an example in which print data is printed on four A3 Nobi sheets, and saddle stitch and A4 cutting are designated as the print control information will be described. This example is illustrated in FIGS. 6A to 6D.

FIGS. 6A to 6D illustrate an example of a print job including a stapling process and a cutting process. First, the control unit 203 instructs the printer unit 206 to print the print data. According to this instruction, printed sheets 501 to 504 are obtained (see FIG. 6A).

Next, under the control of the control unit 203, the printed sheets 501 to 504 are conveyed to the saddle stitcher 308 via the conveyance path 304 in the paper folding machine 301. Then, the control unit 203 instructs the saddle stitch binding machine 302 to saddle-stitch the printed sheets 501 to 504 (see FIG. 6B).

Next, under the control of the control unit 203 a sheet bundle 506 that is saddle-stitched is conveyed to the cutter unit 309 of the trimming machine 303. Then, the control unit 203 instructs the trimming machine 303 to execute an A4 size three side trimming process (see FIG. 6C). Then, the control unit 203 instructs the booklet hold unit 310 to discharge a sheet bundle 507, which is trimmed, from the booklet hold unit 310 (see FIG. 6D).

Further, an example in which print data is printed on four A3 size sheets and Z fold is designated as the print control information will be described. This example is illustrated in FIGS. 7A to 7C.

Figure 7A:
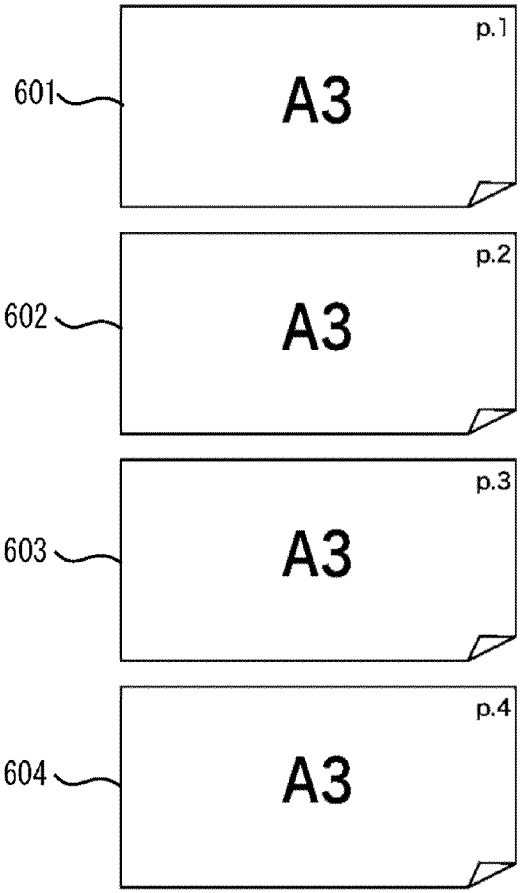
FIGS. 7A to 7C illustrate an example of a print job including folding.
Figure 7B:
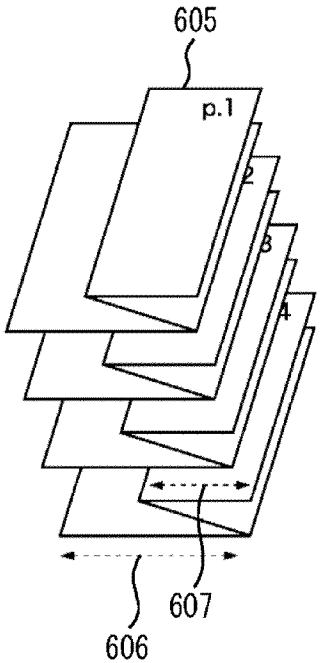
Figure 7C:
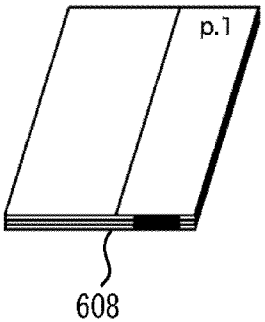

FIGS. 7A to 7C illustrate an example of a print job including the folding process. First, the control unit 203 instructs the printer unit 206 to print the print data. According to this instruction, printed sheets 601 to 604 are obtained (see FIG. 7A).

Next, under the control of the control unit 203, the printed sheets 601 to 604 are conveyed to the Z fold unit 311 of the paper folding machine 301. Then, the control unit 203 instructs the Z fold unit 311 to perform the Z fold process (see FIG. 7B).

At this time, the control unit 203 instructs the Z fold unit 311 so that a width 606 of the bottom portion of the Z fold portion becomes equal to a value obtained by adding an adjustment value stored in the HDD 210 as a setting value to a half of the width of the sheet before the sheet is Z-folded. This adjustment value (offset value) is a recommended adjustment value or a user adjustment value.

Further, the control unit 203 instructs the Z fold unit 311 so that a width 607 of the uppermost portion of the Z-folded sheet becomes equal to a value that is obtained by subtracting an adjustment value stored in the HDD 210 as a setting value from a quarter of the width of the sheet before the sheet is Z-folded. This adjustment value (offset value) is a recommended setting value or a user adjustment value.

For example, if the sheet width is 420 mm before the Z fold and the adjustment value stored in the HDD 210 as the setting value (the recommended adjustment value or the user adjustment value) is +5 mm, then the width 606 of the lowermost portion of the Z-folded sheet will be 215 mm (420 mm/2+5 mm). Further, the width 607 of the uppermost portion of the Z-folded sheet will be 100 mm (420 mm/4−5 mm).

Then, under the control of the control unit 203, the sheet 605 that have undergone the Z fold process is conveyed to the saddle stitch binding machine 302 via the conveyance path 304. At the saddle stitch binding machine 302, a sheet bundle 608 is made. Then the control unit 203 discharges the sheet bundle 608 on the stack tray 307.

According to the exemplary embodiment of the present invention, the Z fold is described as an example of the folding. However, the folding process of the present invention is not limited to the Z fold.

If the folding is affected by the trimming, different types of folding can be included. For example, two fold, four fold, gatefold, and accordion fold can be included. Further, the print job can include a plurality of folding processes.

Further, according to the present exemplary embodiment, as a method for adjusting the folding position of the Z fold, an offset value is stored in the HDD 210. This offset value is added to or subtracted from the width 606 of the lowermost portion of the Z-folded sheet, and the width 607 of the width of the uppermost portion of the Z-folded sheet. However, the present invention is not limited to this method.

For example, a method for adjusting the fold position of the Z fold by designating a ratio of the width 606 of the lowermost portion of the Z-folded sheet and the width 607 of the uppermost portion of the Z-folded sheet to the width of the sheet can be used. Further, the width 606 and the width 607 can be designated using an absolute value for each sheet size.

Figure 8:
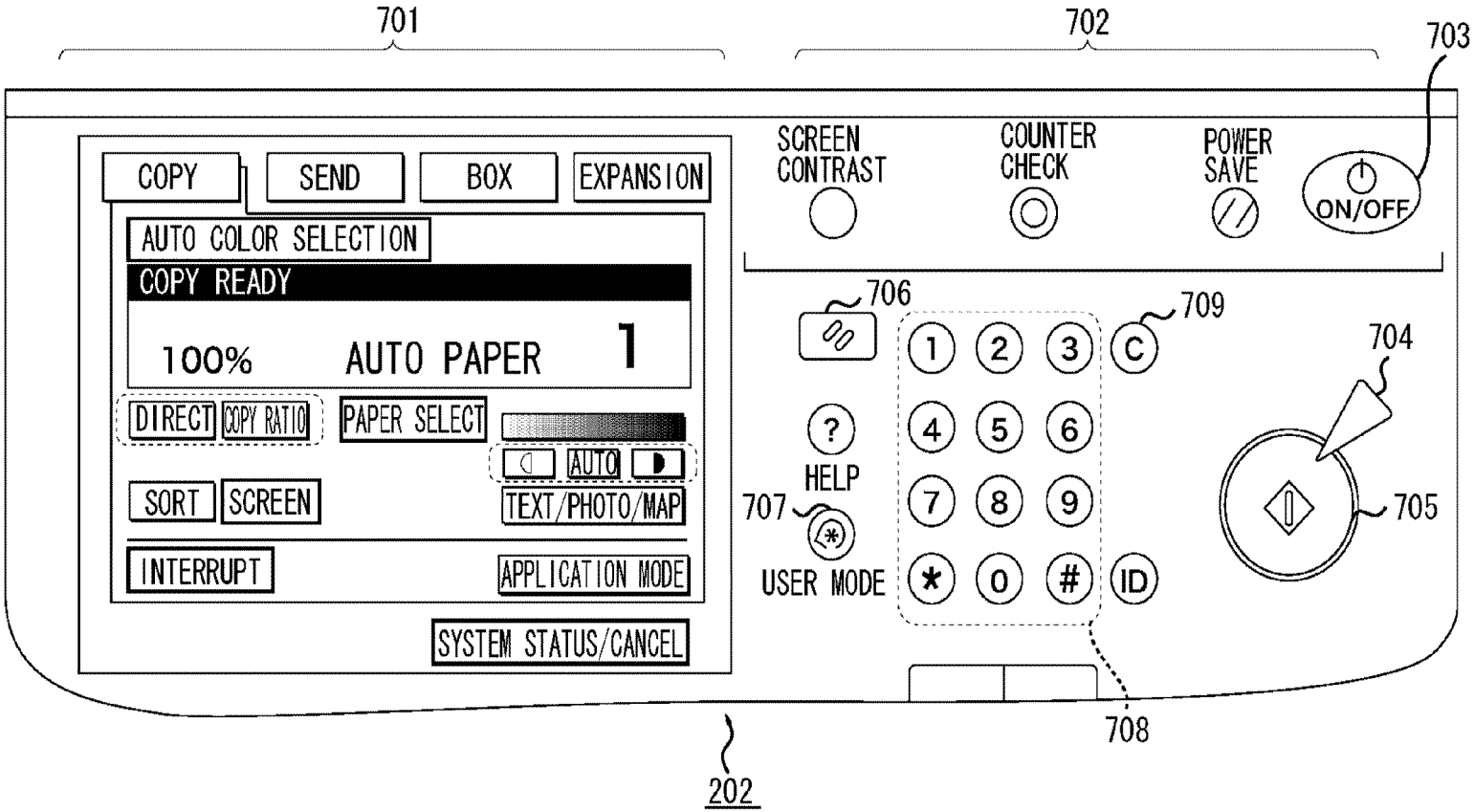
FIG. 8 illustrates an appearance of an operation unit of the printing apparatus.

FIG. 8 illustrates an appearance of the operation unit 202 of the printing apparatus 105.

As described above, the operation unit 202 includes the touch panel unit 701 and the key input unit 702. The touch panel unit 701 includes a liquid crystal display unit and transparent electrodes provided on the display unit. Various setting screens used for receiving instructions from the user are displayed on the touch panel unit 701. The touch panel unit 701 has a function for displaying various screens and an instruction input function for receiving an instruction from the user.

On the other hand, the key input unit 702 includes a power key 703, a stop key 704, a start key 705, a guide key 706, a user mode key 707, and the numeric keys 708. The start key 705 can be pressed by the user to start execution of a copy job or a sending job of the printing apparatus 105. The numeric keys 708 are used when setting, for example, a number of prints to be made.

The control unit 203 controls the printing system 104 so that various processes based on the user's instruction received via the various screens displayed on the touch panel unit 701 or the user's instruction received via the key input unit 702 are performed.

The touch panel unit 701 displays mode buttons used for setting various operation modes such as copy, send, box, and extension as well as various instruction buttons used for setting print ratio and making sheet setting. Since these instruction buttons are well known, their description is omitted.

FIG. 9 illustrates an example of the print control information used for the print job illustrated in FIGS. 6A to 6D. The three-digit numbers described on the left are used for simply indicating row numbers. Thus, they are not included in the print control information.

A <print control information> tag on the 1st row indicates the beginning of the print control information. A <print job> tag on the 2nd row indicates the beginning of a print job included in the print control information. A "number of sheets" attribute indicates a number of sheets included in the print job. Here, the designated number of sheets is four.

A <sheet> tag on the 3rd row indicates the beginning of the sheet information of each sheet included in the print job. A "number" attribute indicates the target sheet. Here, the first sheet to the fourth sheet, that is, all sheets are the target sheets.

A <sheet> tag on the 4th row indicates the sheet information of the target sheet. A "size" attribute indicates the sheet size. Here, the sheet size is A3 Nobi.

A <fold> tag on the 5th row indicates folding information of the target sheet. A "method" attribute indicates the fold method. Here, the fold method is "none", in other words, folding is not performed.

A <bind> tag on the 7th row indicates binding information of all sheets included in the print job. A "method" attribute indicates the binding method. Here, the binding is saddle stitch.

A <trim> tag on the 8th row indicates trim information of all sheets included in the print job. A "size" attribute indicates the trim size. Here, the trim size is A4.

Although the print control information is expressed as illustrated in FIG. 9 according to the present exemplary embodiment, the print control information can be expressed in a different way so long as the folding and the trimming (cutting) methods can be set for each sheet. For example, job definition format (JDF) can be used.

FIGS. 10A to 10D illustrate an example of a print job including mixed output of the sheets that need folding and do not need folding.

Figure 10A:
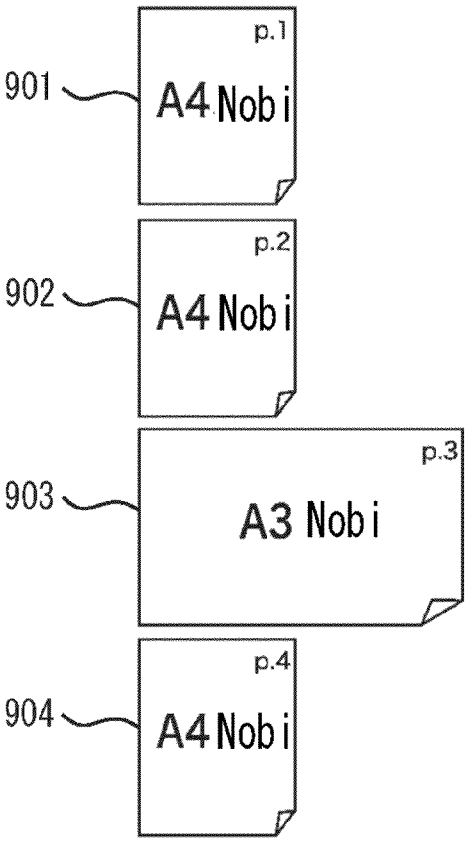
FIGS. 10A to 10D illustrate an example of a print job including mixed output of the sheets that are to be folded and not to be folded.

As illustrated in FIG. 10A, the size of a first sheet 901, a second sheet 902, and a fourth sheet 904 is A4 Nobi, while the size of a third sheet 903 is A3 Nobi.

Figure 10B:
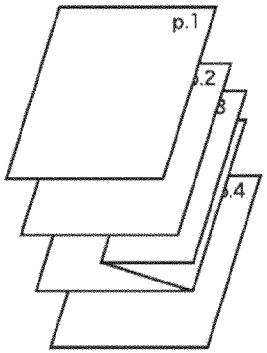
Figure 10C:
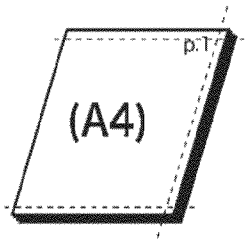

As illustrated in FIG. 10B, the first sheet 901, the second sheet 902, and the fourth sheet 904 are not folded but the third sheet 903 is Z-folded. As illustrated in FIG. 10C, after the 4 sheets are stacked, they are trimmed to be the size of an A4 sheet.

Figure 10D:
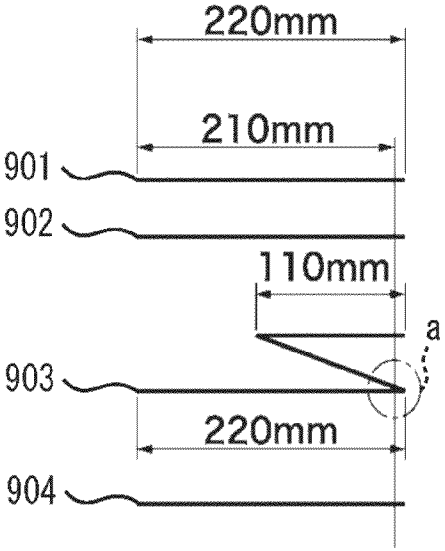

FIG. 10D is a lateral cross section of the trimmed sheets. The A4 Nobi is a bit larger size than the A4 size (210 mm×297 mm). Although the A4 Nobi is not a specified size, according to the present embodiment, a size of 220 mm×307 mm will be taken as an example of the size.

Further, the A3 Nobi is a bit larger size than the A3 size (420 mm×297 mm). Although the A3 Nobi is not a specified size, according to the present embodiment, a size of 440 mm×307 mm will be taken as an example of the size. Further, since the trim size is A4, the sheets are trimmed to be 210 mm×297 mm.

Since the size of the first sheet 901, the second sheet 902, and the fourth sheet 904 is A4 Nobi, their width is 220 mm.

Since the size of the third sheet 903 is A3 Nobi, if the adjustment value stored in the HDD 210 as the setting value is 0 mm, the fold width of the lowermost portion of the Z-folded sheet will be 220 mm according to the above-described calculating formula (440 mm/2+0 mm=220 mm). Further, the fold width of the uppermost portion of the Z-folded sheet will be 110 mm according to the above-described calculating formula (440 mm/4×0 mm=110 mm).

Since the trim width is 210 mm as described above, when the trimming is executed, the bottom end of the Z fold portion is cut off by the trimming (see the circled area "a" in FIG. 10D).

According to the exemplary embodiment of the present invention, A4 Nobi and A3 Nobi sheets are used for describing the embodiment, however, the present invention is not limited to these sheets, and a sheet of an arbitrary size can be used so long as it can be processed by the printing system 104.

FIG. 11 illustrates an example of the print control information used for the print job illustrated in FIGS. 10A to 10D. The three-digit numbers on the left are used for simply indicating row numbers as is with FIG. 9. Thus, they are not included in the print control information.

The tags on the 1st and the 2nd rows are the same as those in FIG. 9. The tags on the 3rd to the 6th rows indicate that the size of the first and the second sheets are A4 Nobi and that they are not folded. The tags on the 7th to the 10th rows indicate that the size of the third sheet is A3 Nobi and that it is Z-folded.

The tags on the 11th to the 14th rows indicate that the size of the fourth sheet is A4 Nobi and that it is not folded. The tag on the 15th row indicates that binding is not performed to all sheets included in the print job. The tag on the 16th row indicates that A4 size trimming is performed to all sheets included in the print job.

Figure 12:
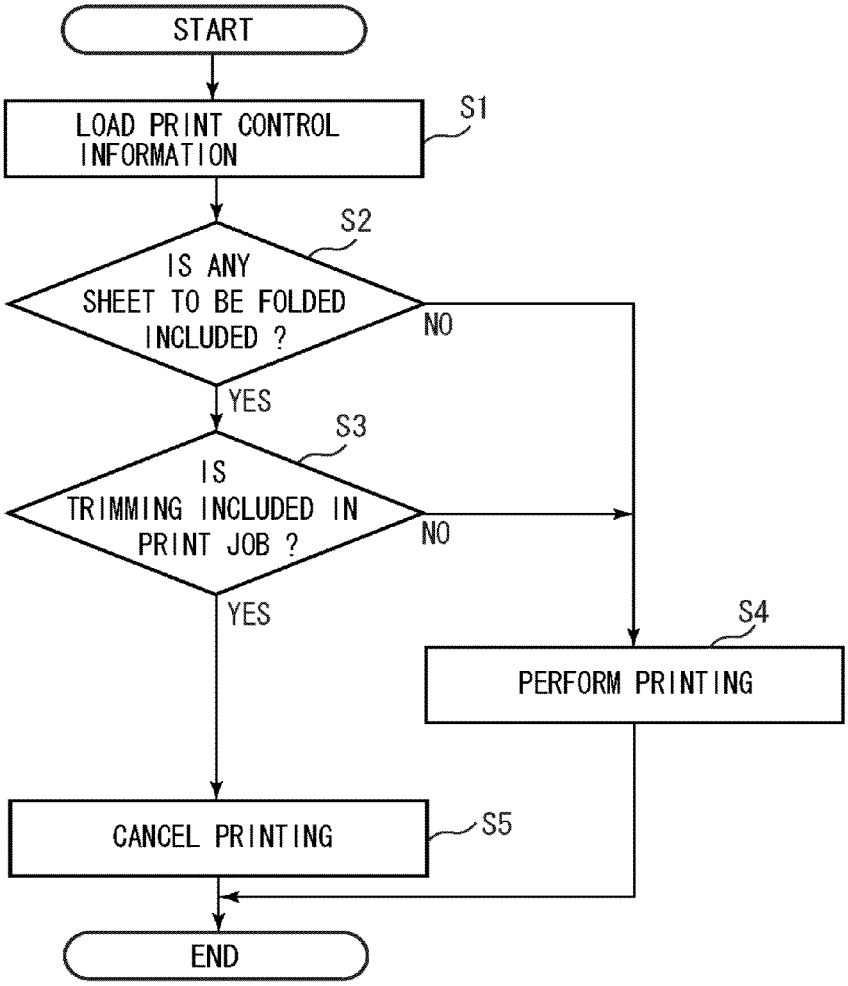
FIG. 12 is a flowchart illustrating a processing procedure of the printing apparatus.

FIG. 12 is a flowchart illustrating a processing procedure of the printing apparatus 105.

The processing program is stored in the ROM 208 and executed by the CPU 204 in the control unit 203. In step S1, the control unit 203 loads the print control information of the designated print job into the RAM 209. In step S2, the control unit 203 sequentially scans the print control information loaded in the RAM 209 in step S1 and determines whether any sheet to be folded is included in the print job. Step S2 is an example of the folding determination process.

If the print job includes a sheet to be folded (YES in step S2), then the process proceeds to step S3. In step S3, the control unit 203 scans the print control information loaded in the RAM 209 in step S1 and determines whether trimming is designated in the print job, that is, whether trimming is included in the print job. The process in step S3 is an example of the trimming determination unit. Steps S2 and S3 can be interchanged.

If trimming is not designated (NO in step S3), or if the print job does not include a sheet to be folded (NO in step S2), then the process proceeds to step S4. In step S4, the control unit 203 performs the normal printing process. In this printing process, the control unit 203 performs printing according to the print data and the print control information included in the print job. Then, the process ends.

On the other hand, if the trimming is designated in step S3 (YES in step S3), the process proceeds to step S5. In step S5, the control unit 203 cancels the printing process and performs the error process. The process in step S3 is an example of the canceling unit. In the error process, the control unit 203 displays a message, for example, illustrated in FIG. 13, on the touch panel unit 701 of the operation unit 202, and notifies the user of the cause of the error.

Figure 13:
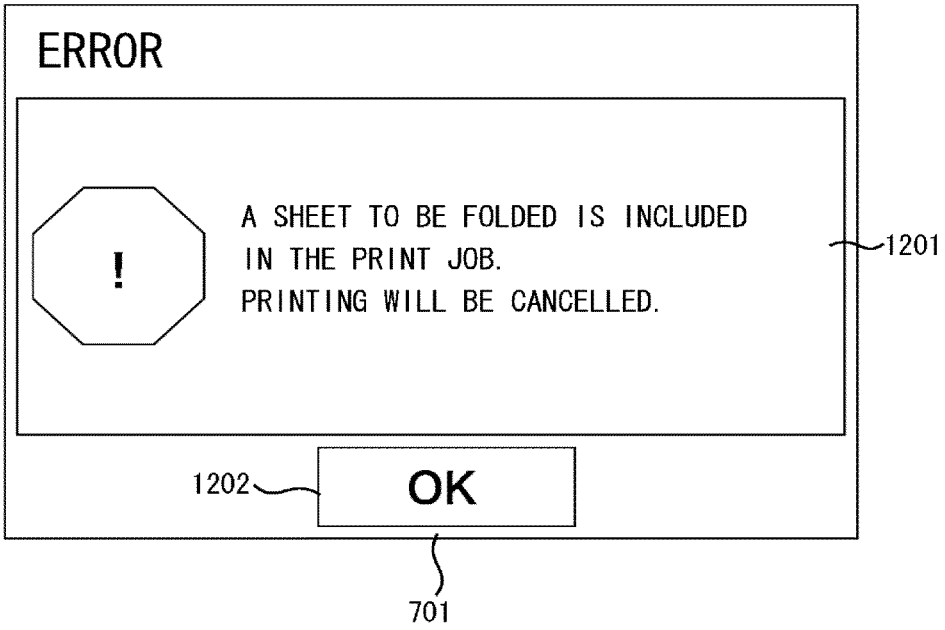
FIG. 13 illustrates a screen of a touch panel unit with an error message.

FIG. 13 illustrates a screen of the touch panel unit 701 with an error message. The following message is displayed on the screen as a message 1201.

"A Sheet Designated to be Folded is Included in the Print Job. Printing will be Cancelled."

When the user selects an OK button 1202 displayed on the touch panel unit 701 and the control unit 203 receives the input, the display of the message ends. Then the process ends.

Here, if the print control information illustrated in FIG. 9 is designated in the print job illustrated in FIGS. 6A to 6D, since folding is not designated to any of the sheets, the determination in step S2 is "NO", and the normal printing process is performed in step S4.

Further, if the print control information illustrated in FIG. 11 is designated in the print job illustrated in FIGS. 10A to 10D, since the Z fold is designated in the third sheet (see the 9th row in FIG. 11), the determination in step S2 is "YES". Additionally, since trimming is designated in the print job (see the 16th row in FIG. 11), the determination in step S3 is also "YES". Accordingly, the printing process is cancelled in step S5.

In this way, according to the printing system of the first exemplary embodiment, accidental trimming of a sheet bundle that includes a folded sheet can be prevented. Thus, even if a specification error is included in a print order or an input error is made by a print operator (user), a sheet bundle that includes a folded sheet will not be trimmed.

According to the first exemplary embodiment, if any folded sheet is included in a print job that includes trimming, the printing process is cancelled. This means that the printing process is cancelled even if the folding position is not affected by the trimming.

According to a second exemplary embodiment, the printing process is executed if the folding position is not affected by the trimming process. Since the components of the printing system according to the second exemplary embodiment are similar to those of the first exemplary embodiment, their description is omitted.

FIGS. 14A to 14D illustrate an example of a print job where the folding position is not affected by the trimming process according to the second exemplary embodiment.

Figure 14A:
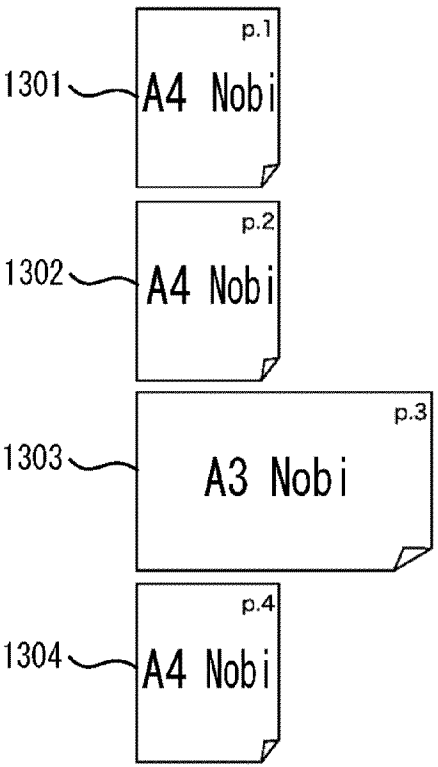
FIGS. 14A to 14D illustrate an example of a print job where a folding position is not affected by trimming (cutting) according to a second exemplary embodiment of the present invention.

As illustrated in FIG. 14A, the size of a first sheet 1301, a second sheet 1302, and the size of a fourth sheet 1304 is A4 Nobi, while the size of a third sheet 1303 is A3 Nobi.

Figure 14B:
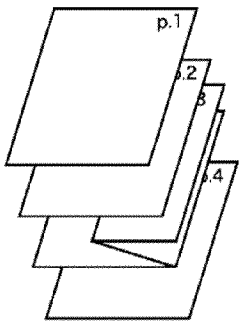
Figure 14C:
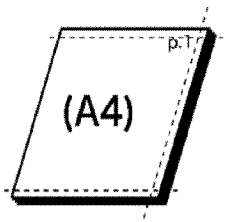

As illustrated in FIG. 14B, the first sheet 1301, the second sheet 1302, and the fourth sheet 1304 are not folded but the third sheet 1303 is Z-folded. As illustrated in FIG. 14C, after the 4 sheets are stacked, they are trimmed to be the size of an A4 sheet.

Figure 14D:
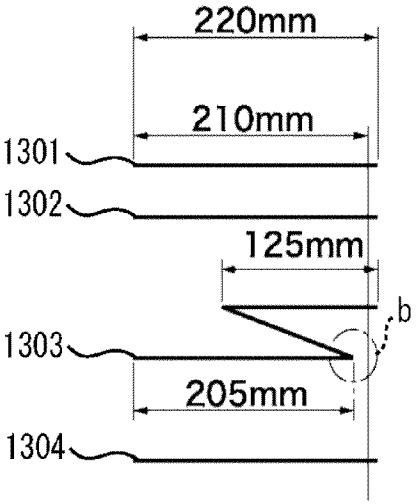

FIG. 14D is a lateral cross section of the trimmed sheets. Here, the A4 Nobi size is 220 mm×307 mm, and the A3 Nobi size is 440 mm×307 mm. Since the size of the first sheet 1301, the second sheet 1302, and the fourth sheet 1304 is A4 Nobi, their width is 220 mm.

On the other hand, the size of the third sheet 1303 is A3 Nobi. If the adjustment value stored in the HDD 210 as the setting value (the recommended adjustment value or the user adjustment value) is −15 mm, then the width of the sheet 1303 at its lowermost Z-folded portion will be 205 mm (440 mm/2+(−15 mm)).

Further, the uppermost portion of the Z-folded sheet will be 125 mm (440 mm/4−(−15 mm)). The trimming width is 210 mm. Thus, even if the trimming is executed, the lowermost portion of the Z-folded portion will not be trimmed (see the circled area "b" in FIG. 14D).

Figure 15:
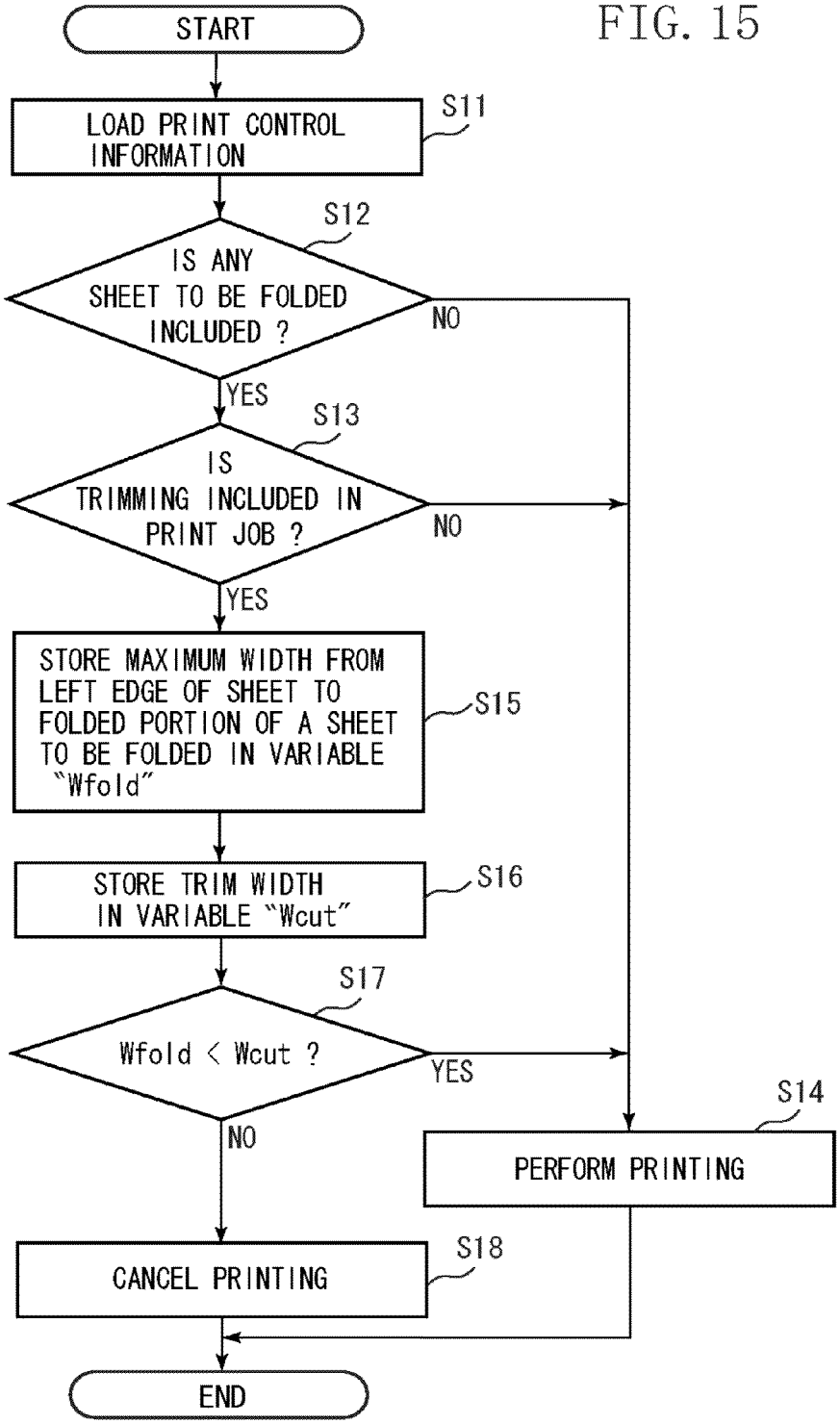
FIG. 15 is a flowchart illustrating a processing procedure of the printing apparatus.

FIG. 15 is a flowchart illustrating a processing procedure of the printing apparatus 105.

The processing program is stored in the ROM 208 and executed by the CPU 204 in the control unit 203. In step S11, the control unit 203 loads the print control information of the designated print job into the RAM 209.

In step S12, the control unit 203 sequentially scans the print control information loaded into the RAM 209 in step S11 and determines whether any sheet to be folded is included in the print job. If the print job includes a sheet to be folded (YES in step S12), then the process proceeds to step S13. In step S13, the control unit 203 scans the print control information loaded into the RAM 209 in step S11 and determines whether trimming is designated in the print job. Steps S12 and S13 can be interchanged.

If trimming is not designated (NO in step S13), or if the print job does not include a sheet to be folded (NO in step S12), then the process proceeds to step S14. In step S14, the control unit 203 performs the normal printing process. In this printing process, the control unit 203 performs printing according to the print data and the print control information included in the print job. After then, the process ends.

On the other hand, if trimming is designated in step S13 (YES in step S13), the process proceeds to step S15. In step S15, the control unit 203 calculates the width of each sheet from the left end to the folding position and stores the maximum value in a variable "Wfold" in the RAM 209.

Step S15 is an example of the folding amount obtaining unit. In this calculation, the print control information loaded into the RAM 209 in step S11 and the setting value (the recommended adjustment value or the user adjustment value) stored in the HDD 210 as the adjustment value are used for each sheet to which folding has been determined in step S12.

In step S16, the control unit 203 calculates the trim width based on the print control information loaded into the RAM 209 in step S11, and stores the calculated value in a variable "Wcut" in the RAM 209. Step S16 is an example of the trim position acquisition unit.

In step S17, the control unit 203 compares the variable "Wfold" with the variable "Wcut" and determines whether the variable "Wfold" is smaller than the "variable Wcut". Step S17 is an example of the comparison determination unit.

If the variable "Wfold" is smaller (YES in step S17), then the process proceeds to step S14. On the other hand, if the variable "Wfold" equals to or greater than the variable "Wcut" (NO in step S17), then the process proceeds to step S18. In step S18, the control unit 203 cancels the printing process.

Figure 16:
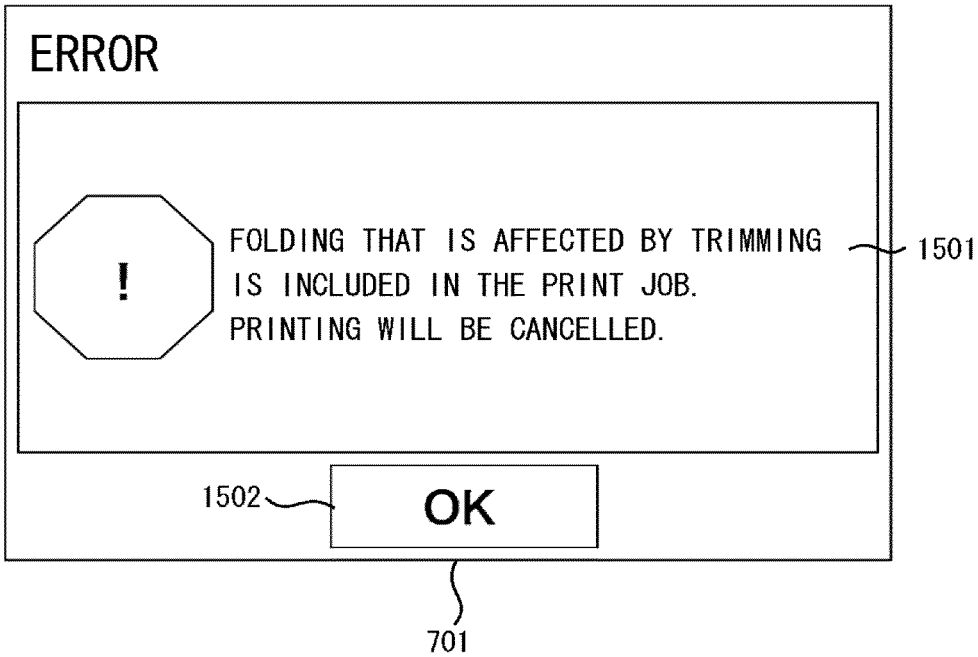
FIG. 16 illustrates a screen of a touch panel unit with an error message.

Before the control unit 203 cancels the printing process, the control unit 203 displays a message, for example, as illustrated in FIG. 16, on the touch panel unit 701 of the operation unit 202 and notifies the user of the cause of the error.

FIG. 16 illustrates a screen of the touch panel unit 701 with an error message. The following message is displayed on the screen as a message 1501.

"Folding that is Affected by Trimming is Included in the Print Job. Printing will be Cancelled."

When the user selects an OK button 1502 displayed on the touch panel unit 701, the control unit 203 receives the input and the display of the message ends. Then the process ends.

If the print control information illustrated in FIG. 9 is designated in the print job illustrated in FIGS. 6A to 6D, since folding is not designated to any of the sheets, the determination in step S12 is "NO", and the normal printing process is performed in step S14.

Further, if the print control information illustrated in FIG. 11 is designated in the print job illustrated in FIGS. 10A to 10D, and further, if the adjustment value stored in the HDD 210 as the setting value is 0 mm, the following processing will be performed.

Since the Z fold is designated to the third sheet (see the 9th row in FIG. 11), the determination in step S12 is "YES". Additionally, since trimming is included in the print job (see the 16th row in FIG. 11), the determination in step S13 is also "YES".

Since folding is designated to only the third sheet, and the width of the sheet from its left end to the folding position is 220 mm, the variable "Wfold" in step S15 will be 220 mm. Further, since the trim width is 210 mm, the variable "Wcut" in step S16 will be 210 mm. Thus, the determination in step S17 is "NO" and the process proceeds to step S18. In step S18, the control unit 203 cancels the printing process.

Further, if the print control information illustrated in FIG. 11 is designated in the print job illustrated in FIGS. 14A to 14D, and further, if the adjustment value stored in the HDD 210 as the setting value is −15 mm, the following processing will be performed.

Since the Z fold is designated to the third sheet (see the 9th row in FIG. 11), the determination in step S12 is "YES". Additionally, since trimming is included in the print job (see the 16th row in FIG. 11), the determination in step S13 is also "YES".

Since folding is designated to only the third sheet, and the width of the sheet from its left end to the folding position is 205 mm, the variable "Wfold" in step S15 will be 205 mm. Further, since the trim width is 210 mm, the variable "Wcut" in step S16 will be 210 mm. Thus, the determination in step S17 is "YES" and the normal printing process will be performed in step S14.

According to the printing system of the second exemplary embodiment, unexpected printing of a sheet can be prevented if a sheet bundle includes a folded sheet whose folding position is affected by the trimming process. Thus, even if the folding position is affected by the trimming due to a specification error included in a print order or an input error is made by a print operator (user), unexpected printing can be prevented.

According to the second exemplary embodiment, if any sheet to be folded is included in a print job that includes the trimming process, and further, if the folded portion is affected by the trimming, the printing process is cancelled. The printing process is cancelled even if the folding position can be adjusted by the user.

According to a third exemplary embodiment, if the folding position can be adjusted by the user, the printing process is executed. Since the components of the printing system according to the third exemplary embodiment are similar to those of the first exemplary embodiment, their description is omitted.

Figure 17:
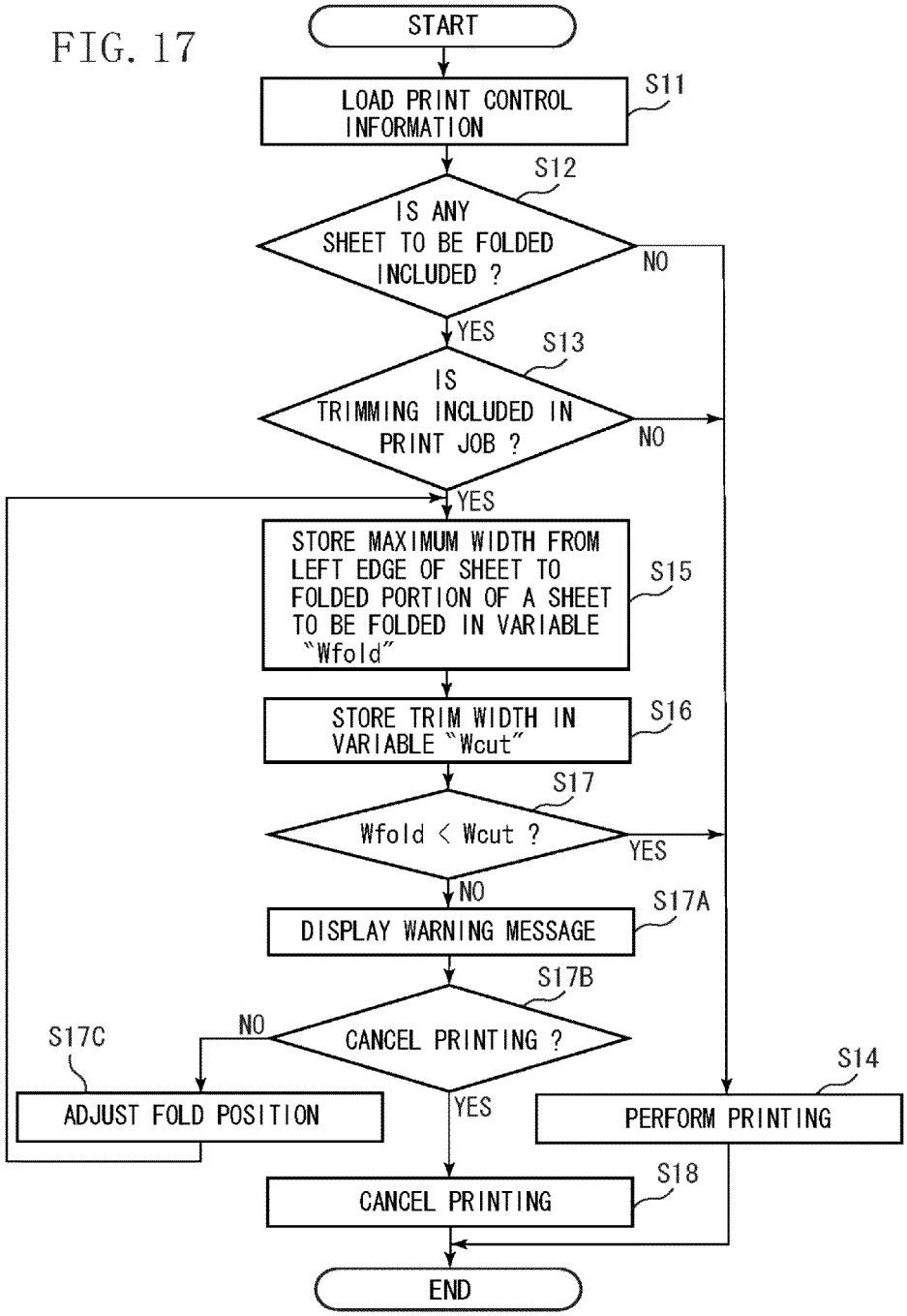
FIG. 17 is a flowchart illustrating a processing procedure of the printing apparatus according to a third exemplary embodiment of the present invention.

FIG. 17 is a flowchart illustrating a processing procedure of the printing apparatus 105 according to the third exemplary embodiment of the present invention.

The processing program is stored in the ROM 208 and executed by the CPU 204 in the control unit 203. Processes similar to those in FIG. 15 of the second exemplary embodiment are denoted by the same step number and the description is omitted for simplification. More specifically, the processes in steps S11 to S17 are the same as those of the second exemplary embodiment.

In step S17, if the variable "Wfold" equals to or greater than the variable "Wcut" (NO in step S17), then, in step S17A, the control unit 203 starts a display process of a warning message. According to this display process, the control unit 203 instructs the touch panel unit 701 of the operation unit 202 to display a message, for example, illustrated in FIG. 18, and notifies the user of the cause of the error. Further, the control unit 203 accepts processing that is input by the user.

Figure 18:
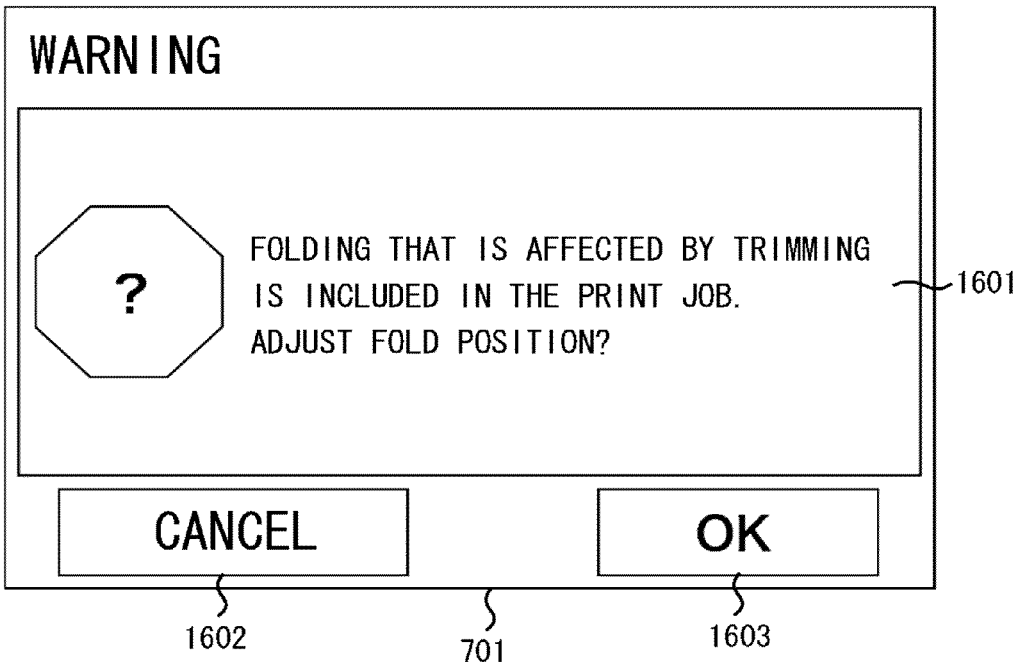
FIG. 18 illustrates a screen of the touch panel unit with a warning message.

FIG. 18 illustrates a screen of the touch panel unit 701 with a warning message. The following message is displayed on the screen as a warning message 1601.

"Folding that is Affected by Trimming is Included in the Print Job. Adjust Fold Position?"

When the user selects an OK button 1603 or a cancel button 1602 displayed on the touch panel unit 701, the control unit 203 receives the input and the display of the message ends.

In step S17B, the control unit 203 determines whether the cancel button 1602 has been pressed by the user. If the control unit 203 determines that the cancel button 1602 has been pressed (YES in step S17B), then the process proceeds to step S18. In step S18, the control unit 203 cancels the printing. Then, the process ends.

In step S17B, if the control unit 203 determines that the cancel button 1602 has not been pressed by the user (NO in step S17B), then the process proceeds to step S17C. In step S17C, the control unit 203 performs the folding position adjustment process. Step S17C is an example of the folding amount adjustment unit. The control unit 203 displays a folding amount on the screen of the touch panel unit 701 of the operation unit 202 in this folding position adjustment process.

Figure 19:
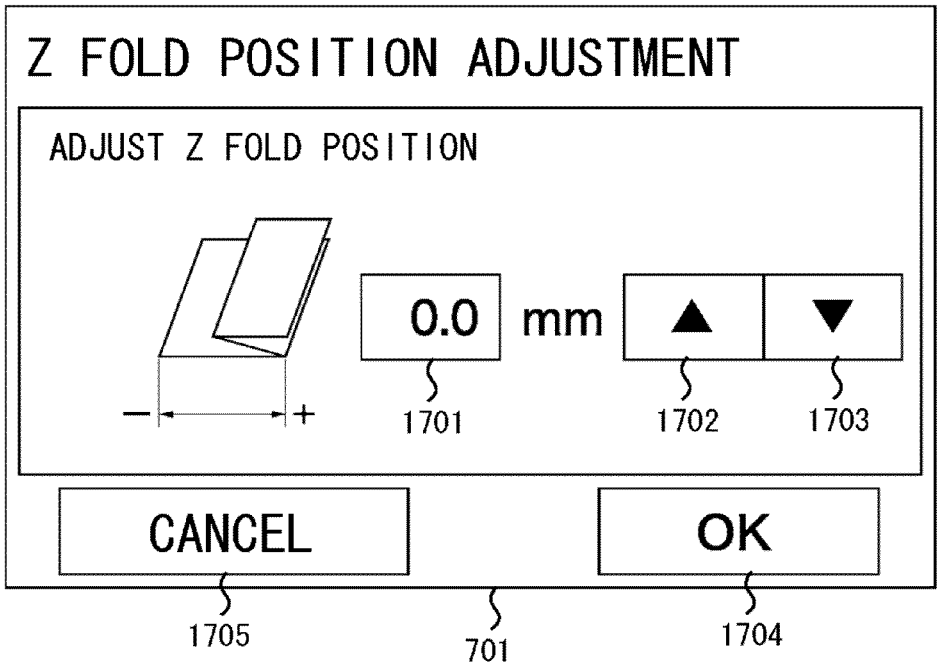
FIG. 19 illustrates a screen of the touch panel unit used for adjusting the folding position.

FIG. 19 illustrates a screen of the touch panel 701 used for adjusting the folding position. Although the adjustment method differs depending on the folding method applied to the sheet in the print job, FIG. 19 illustrates an example of an adjustment screen when the sheet is Z-folded. The user can change the adjustment value stored in the HDD 210 as a setting value (recommended adjustment value or user adjustment value) using the screen.

The user enters a numerical value in a field 1701 of the screen using the numeric keys 708. The control unit 203 determines the entered value and displays the figure in the field 1701.

Further, the user uses buttons 1702 and 1703 on the touch panel unit 701 to change the displayed figure. The control unit 203 determines whether the user has pressed the button 1702 or the button 1703 on the touch panel unit 701.

If the control unit 203 determines that the button 1702 has been pressed, the numeric value in the field 1701 is increased, for example, by 0.5. Similarly, if the control unit 203 determines that the button 1703 has been pressed, the numeric value in the field 1701 is decreased by 0.5.

If the control unit 203 determines that the user has pressed the OK button 1704 or the cancel button 1705 of the touch panel unit 701, the display of the message ends. If the control unit 203 determines that the user has pressed the OK button 1704, the control unit 203 stores the value displayed in the field 1701 in the HDD 210, and the adjustment value stored as the setting value (the recommended adjustment value or the user adjustment value) is replaced with the new value. In step 17C, the fold position is adjusted. Then, the process returns to step S15.

On the other hand, if the control unit 203 determines that the cancel button 1602 has been pressed by the user (YES in step S17B), the process proceeds to step S18. In step S18, the control unit 203 cancels the print process. Then, the process ends.

If the print control information illustrated in FIG. 11 is designated in the print job illustrated in FIGS. 10A to 10D, and further, if the adjustment value stored in the HDD 210 as the setting value is 0 mm, the determination in step S12 is "YES" as the Z fold is designated in the third sheet (see the 9th row in FIG. 11). Additionally, since trimming is included in the print job (see the 16th row in FIG. 11), the determination in step S13 is also "YES".

Since folding is designated to only the third sheet, and the width of the sheet from its left end to the folding position is 220 mm, the variable "Wfold" in step S15 is 220 mm. Further, since the trim width is 210 mm, the variable "Wcut" in step S16 will be 210 mm.

Thus, the determination in step S17 is "NO" and a warning message is displayed in step S17A. If the user does not cancel the printing process in step 17B (NO in step S17B), the process proceeds to step S17C. In step S17C, the folding position is adjusted.

For example, if the adjustment value is set to −20 mm, in step S15, the variable "Wfold" will be calculated as 200 mm (440 mm/2+(−20 mm)) according to the above-described calculating formula. Thus, the determination in step S17 is "YES" and the normal printing process is performed in step S14.

In this way, according to the printing system of the third exemplary embodiment, even if the folding position is affected by trimming, printing can be performed by adjusting the folding position by the printing operator (user). Thus, even if the folding position is affected by the trimming due to a specification error in a print order or an input error made by a print operator, unexpected printing can be prevented.

According to the third exemplary embodiment, if any sheet to be folded is included in a print job that includes the trimming process, and further, if the folded portion is affected by the trimming, the user can adjust the folding position. However, some users have to repeat adjusting through a trial and error process to obtain the appropriate amount of adjustment.

According to a fourth exemplary embodiment, when the adjustment screen of the folding position is displayed in step S17C in FIG. 17, a value that is determined based on the "Wcut−Wfold" value for the adjustment value stored as the setting value (the recommended adjustment value or the user adjustment value) in the HDD 210 is set in advance.

For example, if the print control information illustrated in FIG. 11 is designated in the print job illustrated in FIGS. 10A to 10D and if the adjustment value stored in the HDD 210 as the setting value is 0 mm, as is the same as that of the third exemplary embodiment, the variable "Wfold" is 220 mm and the variable "Wcut" is 210 mm.

At this time, the variable "Wfold" needs to be smaller than 210 mm to make the determination in step S17 "YES". Thus, in displaying the adjustment screen of the folding position in step S17C, a value smaller than the value obtained according to the formula (1) below is displayed in the field 1701. Since the value obtained according to the formula (1) is −10 mm, −10.1 mm, for example, is displayed in the field 1701.

Adjustment value stored in the HDD 210 as setting $$\text{value}-(W\text{fold}-W\text{cut})=0\text{ mm}-(220\text{ mm}-210\text{ mm})=-10\text{ mm} \quad (1)$$

The user can change the adjustment value to an appropriate value with the buttons 1702 and 1703 referring to the recommended adjustment value. The folding amount can be changed to a recommended folding amount referring to the recommended adjustment value.

Thus, according to the printing system of the fourth exemplary embodiment, if the printing operator (user) needs to adjust the folding position, the printing operator (user) is able to know the adjustment amount that is not affected by the trimming in advance. This means that the efficiency of the trial and error approach can be improved.

The present invention is not limited to the configurations of the above-described exemplary embodiments and a different configuration can be applied so long as it can achieve the functions of the configuration of the present exemplary embodiment.

For example, although the Z fold is used as an example of the folding process in the above-described exemplary embodiments, two fold, four fold, gatefold, and accordion fold can also be used. Further, the print job can include a plurality of folding processes. The processes of the above-described exemplary embodiments are applicable to a case where a plurality of fold processes are mixed.

Further, a part or whole of the various determination and control of the above-described exemplary embodiments executed by the control unit 203 (the CPU 204) can be executed by a control unit (CPU) of an apparatus different from the printing apparatus 105.

The apparatus that can execute the determination and the control is, for example, an information processing apparatus such as the server PC 102 or the client PC 103, or a sheet processing apparatus whose type is different from the sheet processing apparatus 205 connected to the printing apparatus 105. For example, the paper folding machine 106, the trimming machine 107, the saddle stitch binding machine 108, or the case binding machine 109 can be used as the apparatus.

In using a control unit (CPU) of the apparatus other than the printing apparatus 105, for example, a control program used for making a computer execute the processes concerning the flowchart of each of the above-described exemplary embodiment is downloaded from a predetermined program supply source to a memory in the apparatus other than the printing apparatus 105. A control program of a user interface such as the various screens described in each exemplary embodiment is also included in the control program.

As the predetermined program supply source, a removable medium that can be connected to the apparatus or a network-connected external server can be used. Further, a part or whole of the processing of the above-described exemplary embodiments can be realized by a CPU of such an apparatus that reads and executes the program stored in an internal memory of the apparatus. The present embodiment can also be applied to such configurations.

Further, although a sheet processing apparatus that is included in a printing system functions as a bookbinding apparatus according to the above-described exemplary embodiments, the present invention is not limited to such an apparatus. As described above, a paper folding machine, a trimming machine, or a saddle stitch binding machine that is connected to a server PC or a client PC connected to a network can function as the bookbinding apparatus. Furthermore, a post processing apparatus that is not connected to the printing apparatus can also execute the functions of the bookbinding apparatus.

Further, in addition to the normal printer, the present invention can be applied to a printing apparatus such as a facsimile machine having print function, or a multifunction peripheral (MFP) having print, copy, and scan functions.

Furthermore, embodiments according to the present invention are not limited to a printing apparatus employing an electrophotographic printing method, as described in the above-described embodiments. The present invention can be applied to printing apparatuses employing various printing methods including, for example, ink jet, thermal transfer, thermal, electrostatic, and discharge breakdown.

Various optional apparatuses (also called as accessory devices or attachment devices) that can expand the functions of the printing apparatus can be arbitrarily connected to the printing apparatus according to a request of the user. For example, as an optional apparatus, a large capacity paper deck that is capable of feeding/conveying large quantities of sheets or a stapling apparatus used for binding image-formed sheets can be connected to the printing apparatus.

Further, a folding apparatus used for folding sheets or a sorting apparatus for sorting sheets, a punching apparatus used for punching binding holes, an automatic two-sided conveyance device used for forming images on both sides of the sheets, an inserting apparatus for inserting a different sheet between sheets, a trimming apparatus used for simultaneously cutting large quantities of sheets, an automatic document feeder used for automatically feeding a document to a scanner, and a fixing post-processing apparatus used for processing the output image to improve quality can be connected to the printing apparatus.

Additionally, a sheet type is not limited, and a medium such as an overhead projector (OHP) transparency film sheet and thick print paper can also be used.

While the present invention has been described with reference to various examples and exemplary embodiments, it is clear to those skilled in the art that the scope of the present invention is not limited to the disclosed exemplary embodiments.

Aspects of the present invention can be achieved by supplying a computer readable storage medium, in which one or more of computer executable instructions and software program code configured to realize the functions according to the above-described exemplary embodiments is stored, to a system or an apparatus, and reading out one or more of the computer executable instructions and program code stored in the computer readable storage medium by a computer (or CPU or MPU) of the system or the apparatus.

In this case, the computer executable instructions and/or program code read out from the storage medium itself may realize functions according to the above-described exemplary embodiments, and the computer readable storage medium that stores the computer executable instructions and/or program code may also fall within the scope of the present invention.

A storage medium for supplying one or more of the computer executable instructions and program may include, for example, at least one of a floppy disk, a hard disk, a magneto-optical disc, a compact disc read-only memory (CD-ROM), a compact disc recordable (CD-R), a compact disc rewritable (CD-RW), a digital versatile disc (DVD) (DVD-ROM, DVD-RAM, DVD-RW, DVD+RW), a magnetic tape, a non-volatile memory card, and a ROM. In addition, the program code and/or computer executable instructions may also be downloaded via a network.

A function according to the above-described embodiments may be realized when the computer executes the computer executable instructions and/or program code read out from the computer readable storage medium. Additionally, an operating system (OS) or the like, which runs on a computer, can execute a part or whole of the actual processing based on the computer executable instructions and/or program code, so that a function according to the above-described embodiments can be achieved. These cases are included in the aspects of the present invention.

Furthermore, one or more of the computer executable instructions and the program code read out from the computer readable storage medium may be written in a memory in a function expanding board inserted in a computer or a function expanding unit connected to a computer, and a CPU provided in the function expanding board or the function expanding unit may perform the whole or a part of the actual processing based on the computer-executable instructions and/or program to realize functions according to aspects of the above-described exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-163667 filed on Jun. 23, 2008, which is hereby incorporated by reference herein in its entirety.

What is claimed is:

1. A sheet processing system comprising:

a processing unit configured to cause a sheet processing unit to execute a a folding processing and a trimming processing on a sheet output by executing a job;

a determining unit configured to determine whether a fold line of the sheet folded by the folding processing is cut out by the trimming processing;

a notifying unit configured to notify, if the determining unit determines that the fold line of the sheet folded by the folding processing is cut out by the trimming process, a user that the fold line of the sheet folded by the folding processing is cut out by the trimming process;

a receiving unit configured to receive an adjustment of the fold line from the user after the notification by the notifying unit; and a control unit configured to control the sheet processing unit to execute the folding processing according to the adjustment of the fold line received by the receiving unit.

2. The sheet processing system according to claim 1, further comprising:

a first obtaining unit configured to obtain a position of the fold line of the sheet folded by the folding processing; and a second obtaining unit configured to obtain a trimming position of the sheet cut out by the trimming processing, wherein the determining unit determines whether the fold line of the sheet folded by the folding processing is cut out by the trimming processing based on a position of the fold line obtained by the first obtaining unit and a trimming position obtained by the second obtaining unit.

3. The sheet processing system according to claim 1, further comprising:

a printing unit configured to print an image on a sheet;

wherein the processing unit causes the folding processing and the trimming processing on the sheet on which the image is printed by the printing unit.

4. The printing system according to claim 1, wherein the notifying unit notifies the user by displaying a message indicating that the fold line of the sheet folded by the folding processing is cut out by the trimming process.

5. The printing system according to claim 1, wherein the determining unit performs determination referring to print control information corresponding to the job.

6. A control method for controlling a sheet processing system, comprising:

causing a sheet processing unit to execute a folding processing and a trimming processing on a sheet output by executing a job;

determining whether a fold line of the sheet folded by the folding process is cut out by the trimming processing;

notifying, if it is determined that the fold line of the sheet folded by the folding processing is cut out by the trimming process, a user that the fold line of the sheet folded by the folding processing is cut out by the trimming process;

receiving an adjustment of the fold line from the user after the notification; and controlling the sheet processing unit to execute the folding processing according to the received adjustment of the fold line.

7. A non-transitory computer readable medium storing a computer executable program for controlling a sheet processing system, the computer executable program comprising:

a code to cause a sheet processing unit to execute a folding processing and a trimming processing on a printed sheet by executing a job;

a code to determine whether a fold line of the sheet folded by the folding processing is cut out by the trimming processing;

a code to notify, if it is determined that the fold line of the sheet folded by the folding processing is cut out by the trimming process, a user that the fold line of the sheet folded by the folding processing is cut out by the trimming process;

a code to receive an adjustment of the fold line from the user after the notification; and a code to control the sheet processing unit to execute the folding processing according to the received adjustment of the fold line.

* * * * *